US005572742A

United States Patent [19]

McFadden

[11] Patent Number: 5,572,742

[45] Date of Patent: Nov. 12, 1996

[54] GARMENT FOR THE DISABLED

[75] Inventor: Elizabeth B. McFadden, Tampa, Fla.

[73] Assignee: Vansur Investments & Asociados, Tampa, Fla.

[21] Appl. No.: 417,802

[22] Filed: Apr. 6, 1995

[51] Int. Cl.[6] ..... A41D 10/00; A41D 13/12

[52] U.S. Cl. ..... 2/114; 2/69; 2/70

[58] Field of Search ..... 2/114, 64, 70, 2/69

[56] References Cited

U.S. PATENT DOCUMENTS

| | | | |
|---|---|---|---|
| 351,549 | 10/1886 | Weimer . | |
| 459,106 | 9/1891 | Fifield | 2/70 X |
| 646,194 | 3/1900 | Sims | 2/114 |
| 818,351 | 4/1906 | Clark | 2/114 |
| 1,028,464 | 7/1912 | Holcomb . | |
| 1,168,698 | 1/1916 | Andrews . | |
| 1,582,385 | 4/1926 | Dauphinais | 2/114 |
| 1,626,450 | 4/1927 | Cannon . | |
| 2,497,764 | 2/1950 | Doughty | 2/114 |
| 2,668,294 | 2/1954 | Gilpin | 2/114 |
| 3,369,256 | 2/1968 | Kern | 2/114 |
| 4,383,335 | 5/1983 | Slocum | 2/114 |
| 4,683,594 | 8/1987 | Feinberg | 2/114 X |
| 4,764,985 | 8/1988 | Wade | 2/114 X |
| 4,864,657 | 9/1989 | Lake | 2/114 |
| 4,995,115 | 2/1991 | Ellis | 2/114 X |
| 5,454,119 | 10/1995 | Thomm | 2/114 |

*Primary Examiner*—C. D. Crowder
*Assistant Examiner*—Shirra L. Jenkins
*Attorney, Agent, or Firm*—C. Douglas McDonald, Jr. & Associates, P.A.

[57] ABSTRACT

A garment for the disabled which may be removed while the disabled person remains sitting the garment comprises two major parts. A body which is openable in the back and a back panel that is attachable to the body of the garment so that the opening through the garment is covered. The back panel remains beneath the user of the garment when the body of the garment is removed. The garment is particularly useful to those unable to stand or for whom standing is difficult, particularly without assistance.

6 Claims, 2 Drawing Sheets

GARMENT FOR THE DISABLED

BACKGROUND OF THE INVENTION

1. Field of the Invention

The present invention relates to clothing for the disabled, more particularly, garments which may be removed while a person remains seated. Such a garment is particularly useful to those unable to stand or for whom standing is difficult without assistance.

2. Description of the Prior Art

Clothing having special openings and breakaway parts is well known in the garment industry. Such clothing addresses very particular problems.

For example, U.S. Pat. No. 1,168,198, issued to H.P. Andrews discloses a jacket in which most of the seams are not stitched but are attached to one another using snaps. When a portion of the jacket is caught in moving machinery, that portion will become detached along the seams by disengaging fasteners thereon, allowing the wearer to escape before being injured by the machinery.

U.S. Pat. No. 341,549, issued to J.P. Weimer discloses a raincoat made for street car drivers. In the front of the raincoat are a series of pockets all covered by a shield or flaps allowing access through the raincoat for various purposes. The raincoat is buttoned in the back, rather than the front, to prevent the rain and wind from entering through a front opening in the coat as the driver in 1886 was primarily exposed to the weather from his front. U.S. Pat. No. 1,028,464, issued to C.C. Holcomb and U.S. Pat. No. 1,626,450, issued to J.W. Cannon both disclose burial garments. These garments are open at the back to provide easy application of the garments by the undertaker while maintaining the appearance of tailor made garments.

Not withstanding the existence of such prior art clothing, it remains clear that there is a need for clothing which will permit a seated disabled person to put on or take off a garment when they are unable to stand. Such a garment must be easily removable from the person's arms and body without the strenuous movement that would be necessary to remove a garment from beneath a seated person.

SUMMARY OF THE INVENTION

The present invention relates to a garment for use by the disabled, particularly those persons that are unable to stand without considerable effort and discomfort either on their own or with assistance.

Most simply stated, the garment for the disabled comprises a body having a top edge and a bottom edge, and a back section that extends longitudinally from the top edge of the body to the bottom edge of the body. The back section is longitudinally separable, defining a first part and a second part, each having a longitudinal edge extending along the line of separation. The back section is further divided into a shoulder section and a skirt section, with the shoulder section including a portion of the top edge and extending to the skirt section, and the skirt section, including a portion of the bottom edge and extending to the shoulder section. The portion of the longitudinal edge that extends along the skirt section of the first part of the back section is spaced apart from the portion of the longitudinal edge of the skirt section of the second part, thereby defining an opening through the back section of the body.

A back panel is removably attachable to the body so that the back panel covers at least a portion of the opening through the back section. The opening through the back section is sized so that when a person is wearing the garment, they are seated on the back panel and not on the back section. Therefore, by detaching the body from the back panel, the person wearing the garment may now remove the body of the garment without having to stand as the back panel remains between the person and the chair while the garment body is free to be removed. The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
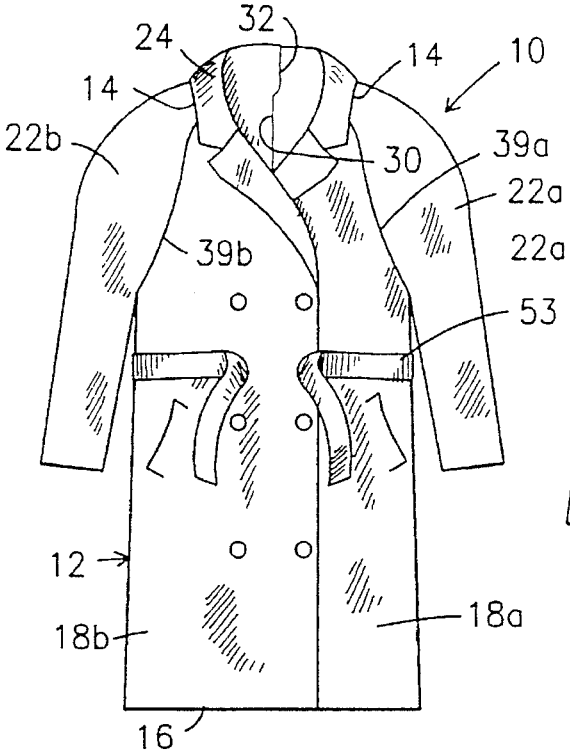
FIG. 1 is a front side elevation of the garment for the disabled.

A preferred embodiment of the garment for the disabled of this invention is illustrated in the drawing FIGS. 1–7. The garment for the disabled is generally indicated as 10 in the views of FIGS. 1, 2, 5, and 6. In the embodiment of the invention illustrated in FIGS. 1–7, the garment illustrated is a double-breasted overcoat in which the two front sections 18*a* and 18*b* overlap one another and may be buttoned up the front. The selection of an overcoat for illustration is simply for convenience, as the invention is suitable for use with any garment that encircles the body of the wearer. Such other garments include but are not limited to short coats, jackets, sweaters, and long vest type garments. For persons with restricted upper body movement the invention is also suitable for blouses, shirts and so forth. The style of the garment and the means for closing the garment front are not a significant part of the invention as any style or closure method may be used. For example, the garment may or may not have sleeves or a belt, and it may have a buttoned front, a zippered front or a totally closed front, and so forth.

Figure 2:
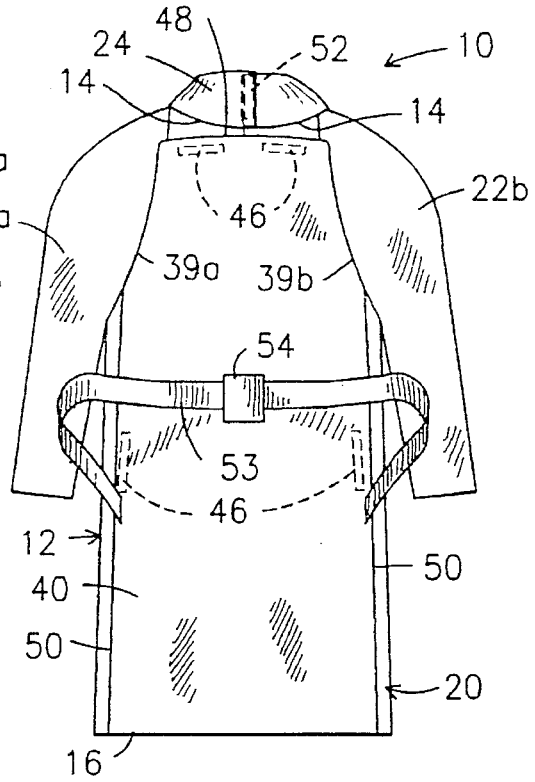
FIG. 2 is a back elevational view of the invention of FIG. 1.

Referring first to FIGS. 1 and 2, it can be seen that garment 10 comprises a body 12 that has a top edge 14 and a bottom edge 16, a pair of overlapping front sections 18 and a back section 20. In this embodiment, the body 12 also includes sleeves 22 and a collar 24, but in other embodiments, the garment 10 may not have sleeves 22 or a collar 24.

Figure 3:
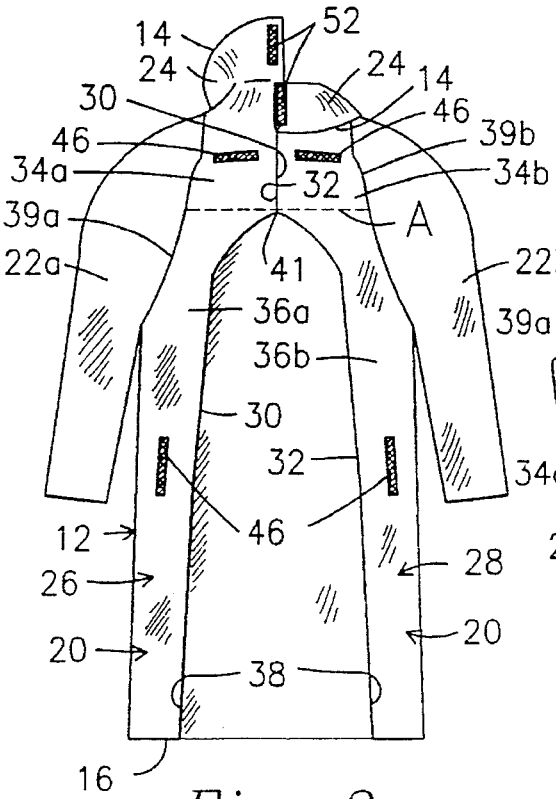
FIG. 3 is the view of the invention of FIG. 2 illustrating the back panel having been removed.
Figure 4:
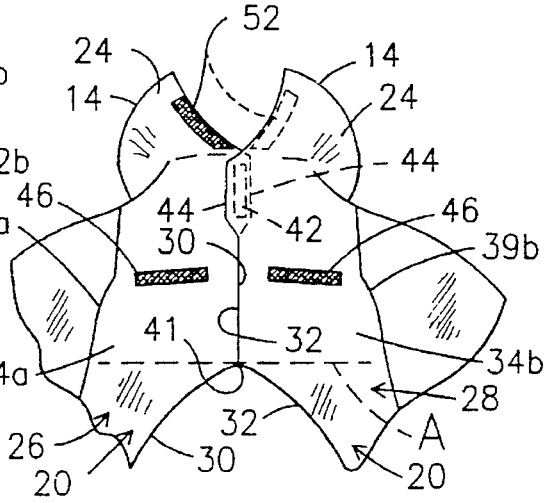
FIG. 4 is a detailed view of the collar portion of the invention of FIG. 3.
Figure 5:
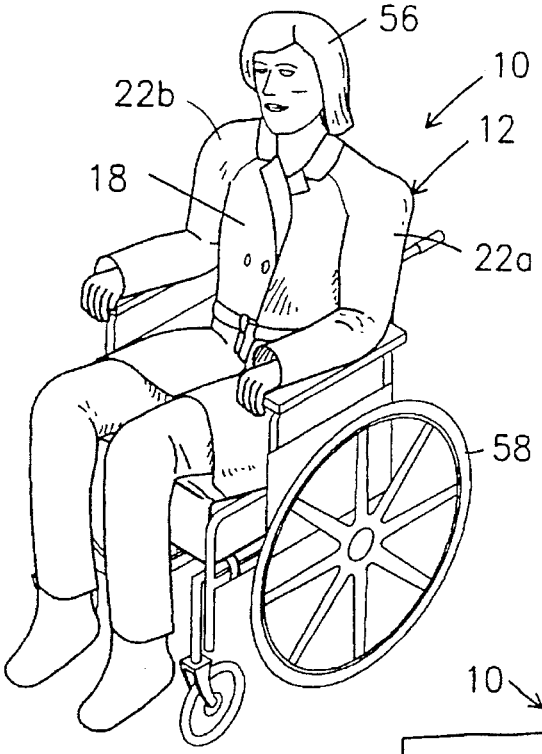
FIG. 5 is an perspective view illustrating a user seated in a wheelchair wearing the garment of this invention.

As can be seen in FIG. 3, the back section 20 extends longitudinally from the top edge 14 to the bottom edge 16 of the body 12. The back section 20 is longitudinally separable thereby defining a first part 26 and a second part 28. The first part 26 and the second part 28 each have a longitudinal edge 30 and 32 respectively. The first part 26 of the back section 20 is comprised of a shoulder section 34*a* and a skirt section 36*a* and the second part 28 of back section 20 is comprised of a shoulder section 34*b* and a skirt section 34*b*. The longitudinal edge 30 extends along the shoulder section 34*a* and the skirt section 36*a* and the longitudinal edge 32 extends along the shoulder section 34*b* and the skirt section 36*b*. The shoulder sections 34*a* and 34*b* include a portion of the top edge 14 and extend to the skirt sections 36*a* and 36*b* respectively. The skirt sections 36*a* and 36*b* include a portion of the bottom edge 16 and extend to the shoulder respectively 34*a* and 34*b*. In this embodiment, line A illustrates the dividing line between the shoulder sections 34*a* and 34*b* and the skirt sections 36*a* and 36*b*. The portion of the longitudinal edge 30 that extends along the skirt section 36*a* of the first part 26 is spaced apart from the portion of the longitudinal edge 32 of the skirt section 36*b* of the second part 28 defining an opening 38 through the back section 20 of the garment 10. The garment 10 has a first arm hole 39*a* defined by the intersection and joining of the front section 18*a* and the first part 26 of the back section 20 with the sleeve 22*a*. The garment 10 has a second arm hole 39*b* defined by the intersection and joining of the front section 18*b* and the second part 28 of the back section 20 with the sleeve 22*b*. As seen in FIGS. 3 and 4, the dividing line A between the shoulder sections 34*a* and 34*b* and the skirt sections 36*a* and 36*b* lies along the upper most portion 41 of opening 38. Line A generally normal to the longitudinal edges 30 and 32 and when the line A is extended it passes through the arm holes 39*a* and 39*b*.

The back panel 40, shown in FIG. 2, is removably attachable to the body 12 so that the back panel 40 covers at least a portion of the opening 38. In FIG. 2 of the embodiment illustrated, it can be seen that the back panel 40 completely covers opening 38.

As seen in FIG. 4, a first attaching means 42 is attached to the shoulder section 34 so that the first part 26 of the back section 20 may be attached to the second part 28 of the back section 20. In this embodiment, the attaching means 42 is comprised of a hook and loop fastener with the hook portion being attached to one part (26 or 28) of the back section 20 and the loop portion of the fastener 42 being attached the other part of the back section 20 so that the hook and loop portions of the attaching means 42 will engage one another when the first part 26 of the back section 20 is aligned with the second part of the back section 20. In this embodiment as illustrated in FIG. 4, the first attaching means 42 is attached to a pair of tabs 44 so that much of the longitudinal edges 30 and 32 of the shoulder sections 34*a* and 34*b* do not overlap and lie adjacent to one another when the first part 26 is properly aligned with the second part 28.

A plurality of second attaching means 46 are spaced about the back panel 40 and similarly about the back section 20 for attachment of the back panel 40 to the back section 20. In this embodiment, the second attaching means 46 comprises hook and loop fasteners with the hook portion of each fastener 46 being attached to the back section 20 and the loop portion being attached to the back panel 40. More particularly as shown in FIGS. 2 and 3, two hook portions of the plurality of second attaching means 46 are attached to the shoulder sections 34*a* and 34*b* and one hook portion is attached adjacent to each longitudinal edge 26 and 28 of the skirt sections 36*a* and 36*b* respectively Corresponding loop portions of the second attaching means 46 are attached along the top edge 48 and along each side edge 50 of the back panel 40, the loop portions being situated so that the each loop portion is joined with a corresponding hook portion of the attaching means 46 thereby attaching the back panel 40 to the body 12.

In this embodiment as shown in FIG. 3 and 4, a collar 24 is formed downwardly from the top edge 14 of the body 12. A portion of the collar 24 is attached to each part 26 and 28 of the back section 20, such that the collar portions are separable one from the other. The portions of the collar 24 are attached to one another by a third attaching means 52, conveniently also a hook and loop fastener as this type of fastener is easier for the disabled to detach and reattach. If desirable, the first attaching means 42, and/or the second attaching means 46 and/or the third attaching means 52, may comprise buttons, snaps, or any other well known method of attachment.

A belt 53 is inserted through a loop 54 that is attached to the back panel 40. The belt 22 assists in maintaining the attachment of the back panel 40 to the body 12 of the garment 10.

Figure 6:
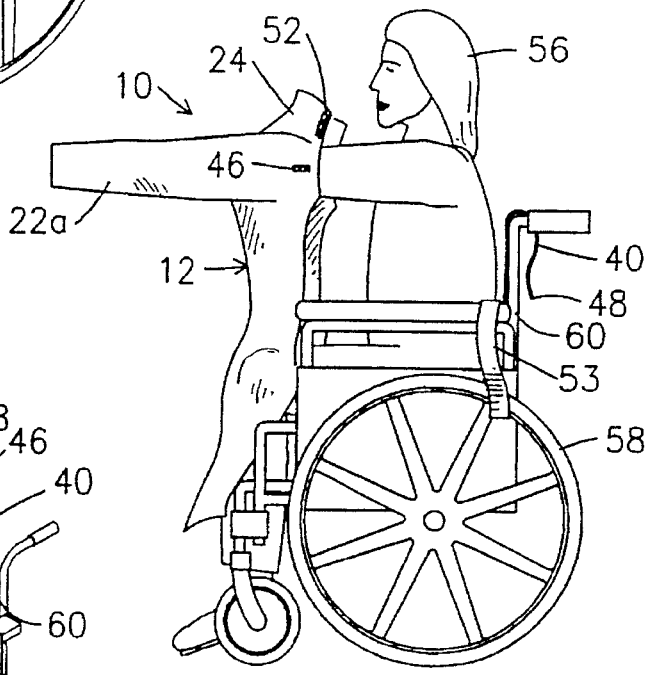
FIG. 6 is a side view of a user in a wheelchair illustrating the removal of the body of the garment of the invention from the user.
Figure 7:
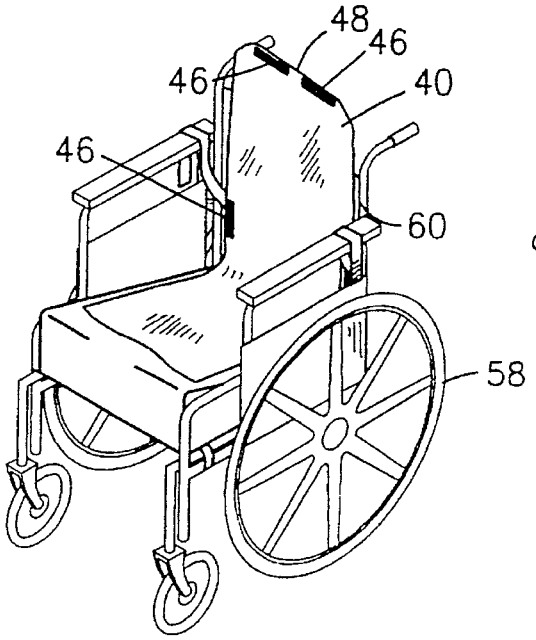
FIG. 7 is a perspective view of a wheelchair illustrating the back panel of the garment remaining in place after the body of the garment has been removed, for clarity the figure of the user is not shown.

Having thus set forth a preferred construction for the garment 10 of this invention, it is to be remembered that this is but a preferred embodiment. Attention is now invited to a description of the use of the garment 10. For illustration purposes, in FIG. 5 the user 56 is wearing the garment 10, an overcoat for wear primarily out of doors, while seated in a wheelchair 58; however, the user 56 may be seated in a theater chair, an automobile or any other similar structure. When coming indoors, if the user 56 is generally mobile, with the exception of his/her legs, the user 56 may easily remove the body 12 of the garment 10 without having to get up from the wheelchair 58. The user 56 will separate the hook and loop portions of each of the attaching means 52, 44 and 46, thereby opening the collar, separating the first part 26 from the second part 28 at the shoulder sections 34*a* and 34*b*and detaching the body 12 from the back panel 40. The body 12 of garment 10 may now be removed by the user 56 leaving the back panel 40 between the user 56 and the wheelchair 58 so that the upper portion is draped over the back 60 of the wheelchair 58 as seen in FIGS. 6 and 7.

If the user 56 desires to wear the garment 10 again, he will insert his arms into the sleeves 22*a* and 22*b* and place the garment 10 around his shoulders so that the first part 26 and the second part 28 of the back section 20 may be reattached at the shoulder sections 34*a* and 34*b* by the first attaching means 42 and so that the two portions of the collar 24 may be reattached by attaching means 52. The top edge 48 of the back panel 40 may no be pulled up so that the loop portions of the two second attaching means 46, arranged along the top edge 48 of the back panel 40, may be attached to the corresponding hook portions of the second attaching means 46 attached to the shoulder section 34. The remaining second attaching means 46 along the side edges 50 of the back panel 40 are then attached so that the back panel fits snugly to the body 12 of the garment 10. The belt 22 may then be retied or buckled at the front.

The garment 10 permits the user 56 to wear a coat that has the same appearance of coats worn by anyone and yet have the flexibility to permit the disabled user to remove the garment when desired with little or no assistance. For more severely disabled persons, this invention will enable the person assisting the disabled person to remove the garment 10 easily with little discomfort to the disabled user.

It will thus be seen that the objects set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A garment for the disabled comprising;

a body having a top edge and bottom edge, said body comprising a back section extending longitudinally from said top edge to said bottom edge, said back section being longitudinally separable thereby defining a first part and a second part, said first part of said back section further comprising a first part shoulder section and first part skirt section, said second part of said back section further comprising a second part shoulder section and a second part skirt section, each of said shoulder section include a portion of said top edge and extend to a respective said skirt section, and each of said skirt sections include a portion of said bottom edge and extend to a respective said shoulder section, said skirt section and said shoulder section of said first part each having a longitudinal edge that is joined to define a first longitudinal edge and said skirt section and said shoulder section of said second part each having a longitudinal edge that is joined to define a second longitudinal edge; said first longitudinal edge along said skirt section of said first part being spaced apart from said second longitudinal edge along said skirt section of said second part defining an opening through said back section; and a back panel removable attachable to said body, such that said back panel covers at least a portion of said opening through said back section.

2. A garment for the disabled as in claim 1 further comprising a first attaching means attached to said back section such that at least a portion of said shoulder section of said first part of said back section is removably attached to at least a portion of said shoulder section of said second part of said back section.

3. A garment for the disabled as in claim 1 further comprising a plurality of second attaching means, each being attached to said body and to said back panel such that said back panel is removably attached to said body.

4. A garment for the disabled as in claim 1 further comprising: a collar formed in said body of said garment adjacent said top edge of said body, a portion of said collar being attached to said first part of said back section and a portion of said collar being attached to said second part of said back section such that said collar portions are separable one from the other; and a third attaching means removably attaching one said collar portion to the other said collar portion.

5. A garment for the disabled as in claim 1 further comprising a belt attached to said back panel.

6. A garment for the disabled comprising;

a body having a top edge and a bottom edge, said body comprising a back section extending longitudinally from said top edge to said bottom edge, said back section being longitudinally separable thereby defining a first part and a second part, said first part of said back section further comprising a first part shoulder section and a first part skirt section, said second part of said back section further comprising a second part shoulder section and a second part skirt section, each of said shoulder sections include a portion of said top edge and extend to a respective said skirt section, and each of said skirt sections include a portion of said bottom edge and extend to a respective said shoulder section, said skirt section and said shoulder section of said first part each having a longitudinal edge that is joined to define a first longitudinal edge and said skirt section and said shoulder section of said second part each having a longitudinal edge that is joined to define a second longitudinal edge; and said first longitudinal edge along said skirt section of said first part being spaced apart from said second longitudinal edge along said skirt section of said second part defining an opening through said back section, said opening having an upper most portion, said body having a first arm hole adjacent said first part of said back section and a second arm hole adjacent said second part of said back section, a straight line defining said shoulder sections from said skirt sections passes along said upper most portion of said opening through said back section and extends through said first and second arm holes; and a back panel removable attachable to said body, such that said back panel covers at least a portion of said opening through said back section.

* * * * *

UNITED STATES PATENT AND TRADEMARK OFFICE

CERTIFICATE OF CORRECTION

PATENT NO. : 5,572,742

DATED : November 12, 1996

INVENTOR(S) : Elizabeth B. McFadden

It is certified that error appears in the above-identified patent and that said Letters Patent is hereby corrected as shown below:

Column 5, line 29, delete "section" and insert therefore--sections--.
line 38, delete ";" and insert therefore--,--.
line 43, delete "removable" and insert therefore--removably--.
Column 6, line 47, delete "removable" and insert therefore--removably--.

Signed and Sealed this

Twenty-third Day of December, 1997

Bruce Lehman

*Attest:*

BRUCE LEHMAN

*Attesting Officer*

*Commissioner of Patents and Trademarks*